US006817478B2

(12) United States Patent
Venegas, Jr.

(10) Patent No.: US 6,817,478 B2
(45) Date of Patent: Nov. 16, 2004

(54) MODULAR OFFICE FURNITURE

(76) Inventor: Frank Venegas, Jr., 5682 Lake Ridge Dr., Brighton, MI (US) 48116

( * ) Notice: Subject to any disclaimer, the term of this patent is extended or adjusted under 35 U.S.C. 154(b) by 0 days.

(21) Appl. No.: 10/022,002

(22) Filed: Dec. 14, 2001

(65) Prior Publication Data

US 2002/0179558 A1 Dec. 5, 2002

Related U.S. Application Data

(60) Provisional application No. 60/294,790, filed on May 31, 2001.

(51) Int. Cl.[7] ..... A47F 5/00

(52) U.S. Cl. ..... 211/189; 211/182; 211/186

(58) Field of Search ..... 211/182, 189, 211/186; 52/36.1, 36.4; 403/379.3, 362, 408.1, 306, 311, 312, 169, 178, 292, 298, 300, 345, 375, 359.1, 359.5, 337, 379.6, 297; 108/12, 180, 189

(56) References Cited

U.S. PATENT DOCUMENTS 2,150,651 A * 3/1939 Ewing ..... 403/201
2,581,032 A * 1/1952 Landsman ..... 403/48
2,654,487 A * 10/1953 Degener ..... 211/188
2,896,789 A * 7/1959 Sans et al. ..... 108/28
3,254,774 A * 6/1966 Schild ..... 211/182
3,361,088 A 1/1968 Hodgkin ..... 108/12
3,839,834 A * 10/1974 Goddard ..... 52/243
3,977,800 A * 8/1976 Cassell ..... 403/172
4,224,769 A 9/1980 Ball et al. ..... 52/36
4,448,003 A * 5/1984 Hasbrouck ..... 52/239
4,470,232 A 9/1984 Condevaux et al. ..... 52/220
4,630,550 A * 12/1986 Weitzman ..... 108/155
4,631,881 A 12/1986 Charman ..... 52/220
4,685,255 A 8/1987 Kelley ..... 52/36
4,715,154 A 12/1987 Baloga ..... 52/239

(List continued on next page.)

*Primary Examiner*—Carl D. Friedman
*Assistant Examiner*—Jennifer E. Novosad
(74) *Attorney, Agent, or Firm*—Gifford, Krass, Groh, Sprinkle, Anderson & Citkowski, PC

(57) ABSTRACT

A modular office cubicle system includes multiple vertical members each having lower ends designed to rest on a floor. Multiple horizontal members extend between the vertical members such that the vertical and horizontal members cooperate to form a skeletal work cubicle at least partially surrounding a work area. Structural connection fittings removably interconnect the horizontal members with the vertical members. Removable and replaceable polymerized sheathing surrounds at least some of the vertical members and some of the horizontal members. A generally planar work top may be supported by some of the members in a generally horizontal position.

31 Claims, 3 Drawing Sheets

U.S. PATENT DOCUMENTS 4,771,583 A 9/1988 Ball et al. ..... 52/221
4,876,835 A 10/1989 Kelley et al. ..... 52/239
4,905,428 A 3/1990 Sykes ..... 52/126.4
4,974,915 A 12/1990 Bussard ..... 312/236
5,038,539 A 8/1991 Kelley et al. ..... 52/239
5,044,135 A 9/1991 Kroon et al. ..... 52/239
5,058,331 A 10/1991 Epps ..... 52/36
5,061,000 A * 10/1991 Haugen et al. ..... 403/297
5,103,987 A * 4/1992 Davis ..... 211/43
5,169,258 A * 12/1992 Raynak ..... 403/170
5,219,406 A 6/1993 Raz ..... 160/135
5,287,666 A 2/1994 Frascaroli et al. ..... 52/239
5,309,686 A 5/1994 Underwood et al. ..... 52/29
5,394,658 A 3/1995 Schreiner et al. ..... 52/36.1
5,406,760 A 4/1995 Edwards ..... 52/239
5,429,417 A * 7/1995 Kim ..... 297/440.1
5,520,293 A * 5/1996 Hartley ..... 211/182
5,611,123 A * 3/1997 Prizzi ..... 24/459
5,687,513 A 11/1997 Baloga et al. ..... 52/32
5,722,544 A * 3/1998 Williams ..... 211/188
5,725,106 A * 3/1998 Wilson ..... 211/13.1
5,743,412 A * 4/1998 Noble ..... 211/182
5,746,034 A 5/1998 Luchetti et al. ..... 52/220.7
5,746,334 A * 5/1998 Brandenberg ..... 211/182
5,860,253 A * 1/1999 Lapointe ..... 52/98
5,878,802 A * 3/1999 Richter et al. ..... 160/135
5,943,834 A 8/1999 Jeffers et al. ..... 52/239
6,036,034 A * 3/2000 Battaglia et al. ..... 211/187
6,183,167 B1 * 2/2001 Ruiz et al. ..... 405/251
6,223,917 B1 * 5/2001 Bruder ..... 211/189
6,226,933 B1 * 5/2001 Nelson et al. ..... 52/101
6,233,826 B1 * 5/2001 Wycech ..... 29/897.1
6,247,869 B1 * 6/2001 Lichvar ..... 403/205
6,581,616 B1 * 6/2003 Venegas, Jr. ..... 135/121

* cited by examiner

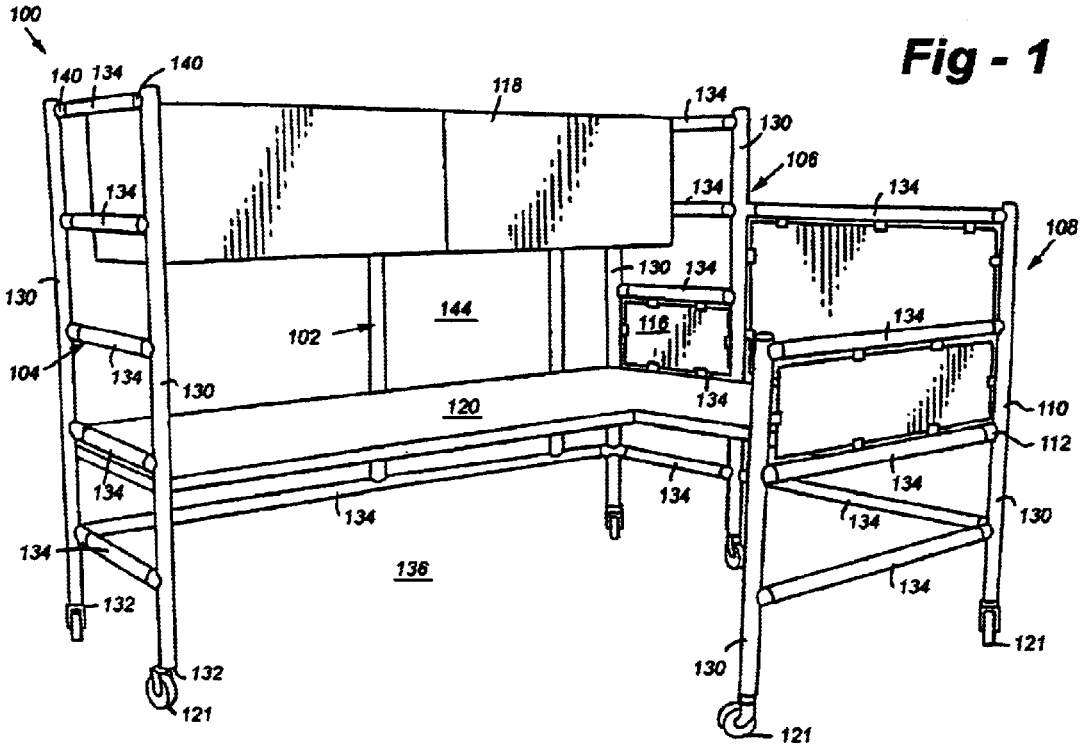
Fig - 1
Fig - 2A
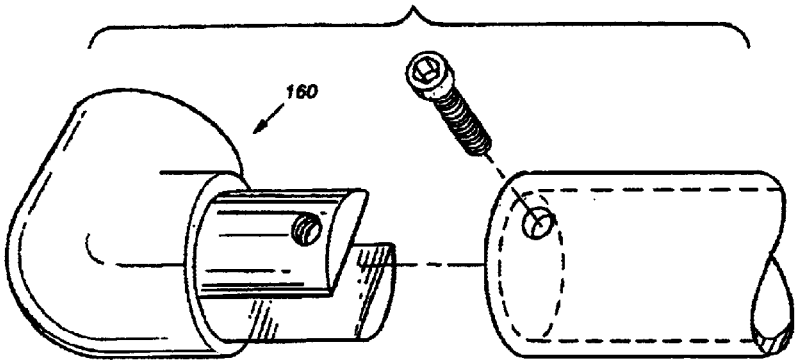
Fig - 2B
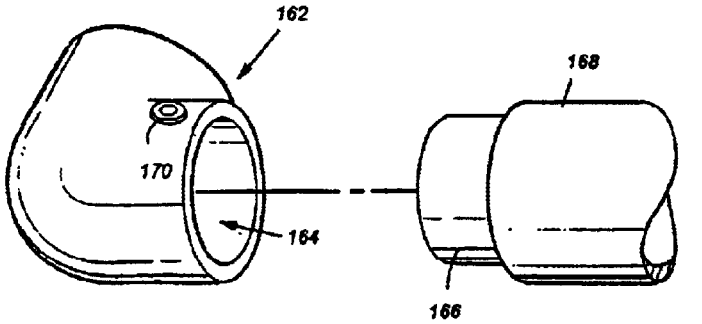

MODULAR OFFICE FURNITURE

REFERENCE TO RELATED APPLICATIONS

This application claims priority from U.S. provisional patent application Ser. No. 60/294,790, filed May 31, 2001, the entire contents of which are incorporated herein by reference.

FIELD OF THE INVENTION

This invention relates generally to knock-down type structures and, in particular, to office furniture that may be easily assembled and disassembled using covered tubular members.

BACKGROUND OF THE INVENTION

In the realm of office furniture, the trend has been away from solid and permanent installations to flexible configurations that may be easily altered to suit new working conditions. This trend probably grew out of mobile computing environments, where individual workers may need to temporarily perform services in one of a variety of different locations. This trend toward modular, flexible working environments is also strengthened by the diverse needs of different workers, in terms of table space, storage area, the need for privacy, and other factors.

SUMMARY OF THE INVENTION

A modular office cubicle system according to the present invention includes a plurality of vertical members which each have lower ends configured to rest on a floor. A plurality of horizontal members extends between the vertical members such that the vertical and horizontal members cooperate to form a skeletal work cubicle at least partially surrounding a work area. Structural connection fittings removably interconnect the horizontal members with the vertical members. Removable and replaceable polymerized sheathing surrounds at least some of the plurality of vertical members and some of the plurality of horizontal members. A generally planar worktop is preferably supported by some of the members in a generally horizontal position.

BRIEF DESCRIPTION OF THE DRAWINGS

FIG. 1 is a perspective view of an embodiment of a modular office cubicle system according to the present invention;

FIG. 2A is a perspective view of one embodiment of a structural fitting for use with the present inventions;

FIG. 2B is a perspective view of another embodiment of a structural fitting for use with the present invention;

DESCRIPTION OF THE INVENTION

Figure 3:
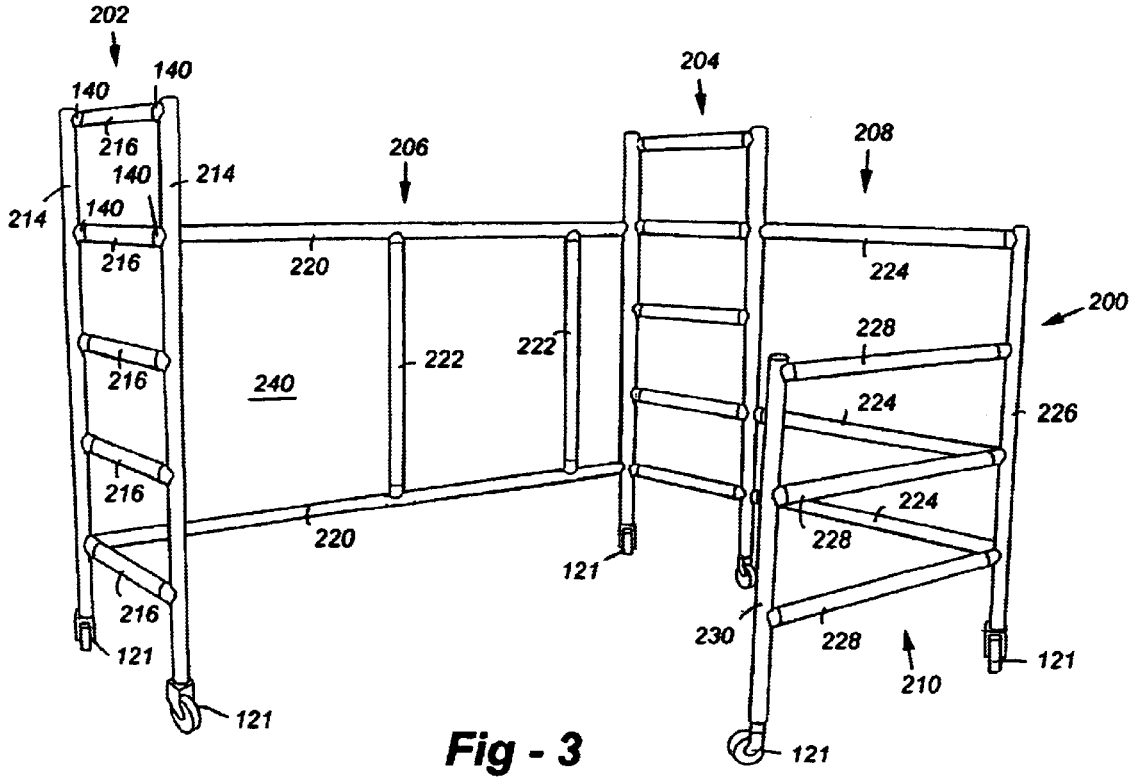
FIG. 3 is a perspective view of a basic embodiment of the present invention.

Broadly, this invention addresses the need for modular office furniture by providing partitions, work surfaces, storage facilities, and so forth, constructed using tubular metal members covered with polymeric material, resulting in a structure that may be easily assembled, modified and disassembled, while, at the same time, may assume different shapes, colors and other appearances with little, if any, maintenance.

A basic module according to the invention is shown at 100 in FIG. 1. This particular configuration includes a back wall 102, two side partitions 104 and 106, and an L-shaped extension 108, all constructed using tubular members such as 110, joined by fittings such as 112. Infill panels 114 and 116 may be used, as desired, as shown in the back wall 102 and a portion of the side partition. In between the partitions 104 and 106, in the preferred embodiment there is hung an upper storage cabinet 118 and work surface 120.

The tubular members 110 are preferably circular in cross-section, and are covered with a polymeric material such as polyethylene, polypropylene, nylon, or other suitable material, affording changes in color while reducing maintenance. Preferably, the members are aluminum, though steel or even certain plastics may be used. The vertical members are preferably constructed onto casters 121, enabling the entire modular to be rolled from place to place in conjunction with one or more chairs. The fittings may be L-shaped, T-shaped, or have multiple, orthogonal axes, as appropriate, and the sheathing may either extend into the fitting, or be flush therewith, as shown in FIGS. 2A and 2B.

The vertical and horizontal members 130 and 134 preferably are hollow metal tubes. Polymerized sheathing fits around the outer diameter of the tubes and extends substantially the entire length so as to give a durable and aesthetically pleasing appearance. The heating has an inner diameter equal to or slightly greater than the outside diameter of the metal tubes.

Referring again to FIG. 1, a modular office cubicle system according to the present invention will be described in more detail. This system preferably includes a plurality of vertical members 130 each having lower ends 132 configured to rest on a floor. In some embodiments, the lower end 132 comprises a caster for easy mobility of the cubicle system 100. A plurality of horizontal members 134 extend between the vertical members such that the vertical and horizontal members cooperate to form a skeletal work cubicle at least partially surrounding a work area 136. Structural connection fittings removably interconnect the horizontal members with the vertical members. Structural connection fittings for use with the present invention come in several varieties, such as shown in FIGS. 2A, 2B, and 2C.

Figure 2C:
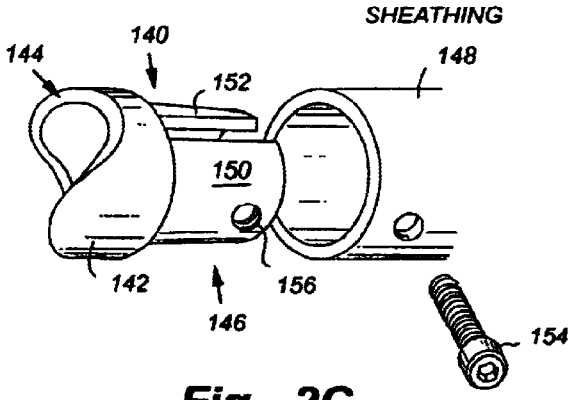
FIG. 2C is a perspective view of yet another embodiment of a structural fitting for use with the present invention.

A preferred embodiment of the structural fitting is shown in FIG. 2C at 140. The structural fitting 140 has a base 142 with a radiused end surface 144. The radiused end surface 144 is designed to fit against the outer surface of one of the vertical or horizontal members. Preferably, this radiused end surface 144 fits against the outside diameter of the polymeric sheathing on one of the tubular members, such as a vertical member. The base 142 is fastened to the member against which the radiused end surface fits by a concentric fastener that extends through the center of the base and into the member. An engagement member 146 extends from the base 142 and is configured to engage the inner diameter of one of the tubes such as shown on 148. The tube 148 is preferably another hollow metal tube with a polymeric outer sheathing, not shown. The engagement member 146 preferably comprises a pair of engagement fingers 150 and 152 that have generally arcuate outer surfaces designed to fit into the interior diameter of the tube 148. The fingers may be a slip or press fit into the tube 148. However, the fitting 140 preferably includes a fastener such as set screw or bolt 154 that engages a threaded hole 156 in one of the fingers 150. The screw 154 presses against the inside of the other finger 152 such that when the screw 154 is tightened, the fingers 150 and 152 are spread apart. Therefore, the tube 148 may be placed onto the fingers 150 and 152. The screw 154 is then passed through a hole in the tube 148 and engages the hole 156 in the finger 150. As the screw is tightened, the fingers 150 and 152 are spread apart so that they tightly engage in the inside of the tube 148. This type of structural fitting can be seen throughout the modular office cubicle 100 as shown in FIG. 1, and as indicated in several places as 140. Preferably, the fitting 140 gives a very flush and finished appearance. The base 142 has an outer diameter equal or similar to the outer diameter of the tube 148, or, most preferably, the sheathing that covers the tube 148. Therefore, the base 142 smoothly transitions to the tube it connects to. In some of the embodiments, the horizontal and vertical members are tubes of the same diameter. In this case, the end surface 144 of the base 142 has a radius the same as the radius of the side surface of the base 142.

FIG. 2A shows an alternative structural connection fitting 160. This fitting 160 is elbow-shaped and includes an engagement finger-similar to the fitting 140. As can be seen in FIG. 1, the fittings 140 may be used to interconnect horizontal members 134 to the side of vertical members 130. Alternatively, an elbow fitting could be used such as shown in FIG. 2A. The elbow fitting 160 may have engagement fingers on both of its ends, or a different type of fitting on one of its ends. The fittings 140 and 160 are considered to be slip-in fittings since the engagement fingers slip inside of the tubes to which they connect.

FIG. 2B shows an alternative slip-on fitting 162. The fitting 162 is shown as an elbow fitting, but may be provided with many other shapes. Likewise, the fittings 140 and 160 may come in other shapes, such as T-shaped elbow, elbow, four-way, and more complex fittings. The fitting 162 has an opening 164 in one of its legs that has an inside diameter equal to or slightly larger than the outer diameter of a tube 166 or its polymerized sheathing 168. If it is sized slightly larger than the tube 166, the tube is slid into the opening 164 and preferably a set screw 170 is tightened to push against the outer surface of the tube 166. The sheathing 168 then may be slid up flush against th end of the fitting 162 to give a finished appearance. Alternatively, the opening 164 may have a larger diameter such that the tube 166 and outer sheathing 168 both slide into the opening 164. The length of sheathing 168 may extend to the length of tube 166, in which case the outer diameter of sheathing 168 may fit into opening 164, enabling set screw 170 to press against the sheathing 168. The set screw 170 can then be tightened against the outer sheathing. The set screw, in this embodiment, preferably has a rounded end such that it presses against the outer sheathing and locks the tube 166 and sheathing 168 into the fitting 162 without penetrating the sheathing 168. Ultimately, it may penetrate the sheathing. The fittings such as shown in FIGS. 2A–2C are preferably fittings available from Hollaender, with the slip-in fittings known as Interna-Rail®.

Referring now to FIG. 3, a modular office cubicle system according to the present invention, consisting only of vertical and horizontal members and the structural fittings used to interconnect them, is shown at 200. This embodiment of the present invention may be considered to have a first side partition 202, a second side partition 204, a back wall 206 extending between the side partitions 202 and 204, a side wall 208 extending from one of the side partitions 204 and a front wall 210 extending from the side wall 208. Each of the side partitions 202 and 204 have a ladder-like configuration and are preferably identical to one another. Side partition 202 includes a pair of vertical members 212 and 214 that are generally parallel to one another and spaced apart. Five generally parallel horizontal members 216 extend between the vertical members 212 and 214 and are spaced apart from one another at intervals much like rungs of a ladder. The horizontal members 216 are preferably interconnected with the vertical members 214 by a plurality of structural connection fittings 140. The side partition 204 is constructed similarly. The rear wall 206 extends from the rearmost vertical member of each of the side partitions and preferably includes two or more horizontal members 220. Vertical members 222 may interconnect the horizontal members 220.

The side wall 208 extends from the forwardmost vertical member of the second side partition 204 and is aligned therewith. It includes multiple horizontal members 224 that extend from the side partition 204 to a vertical corner member 226. The front wall 210 extends preferably perpendicularly from the side wall 208. It preferably includes several horizontal members 228 that extend from the corner member 226 to a vertical end member 230. As will be clear to those with skill in the art, the various elements of the cubicles 100 and 200 may be arranged in other manners than those illustrated without departing from the scope of the invention. The ladder-like side partitions 202 and 204 provide particular utility. Referring again to FIG. 1, the storage cabinet 118 and the generally horizontal worktop 120 may be supported from "rungs" of these side partitions.

Figure 5:
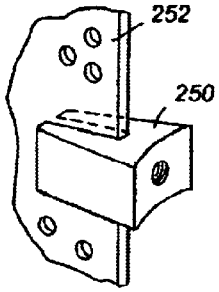
FIG. 5 is a perspective view of a portion of an infill panel and one embodiment of a support member for supporting the infill panel.

Referring again to FIG. 3, the various horizontal and vertical members define a plurality of generally vertical framed areas such as 240. Infill panels may be supported in any or all of the framed areas as needed to provide privacy or functionality. FIG. 5 shows a preferred fastener 250 for supporting an infill panel 252. Infill panels may be mesh panels, solid panels, fabric covered, sound absorption panels, corkboard, or any other type of panel desired for the application. The panels may also be easily changed to provide different functionality or to update the appearance of the cubicle. The infill panels preferably consume substantially all of the framed area in which they are placed. A small gap may surround the perimeter of the infill panel to give room for the connectors 250.

Figure 4:
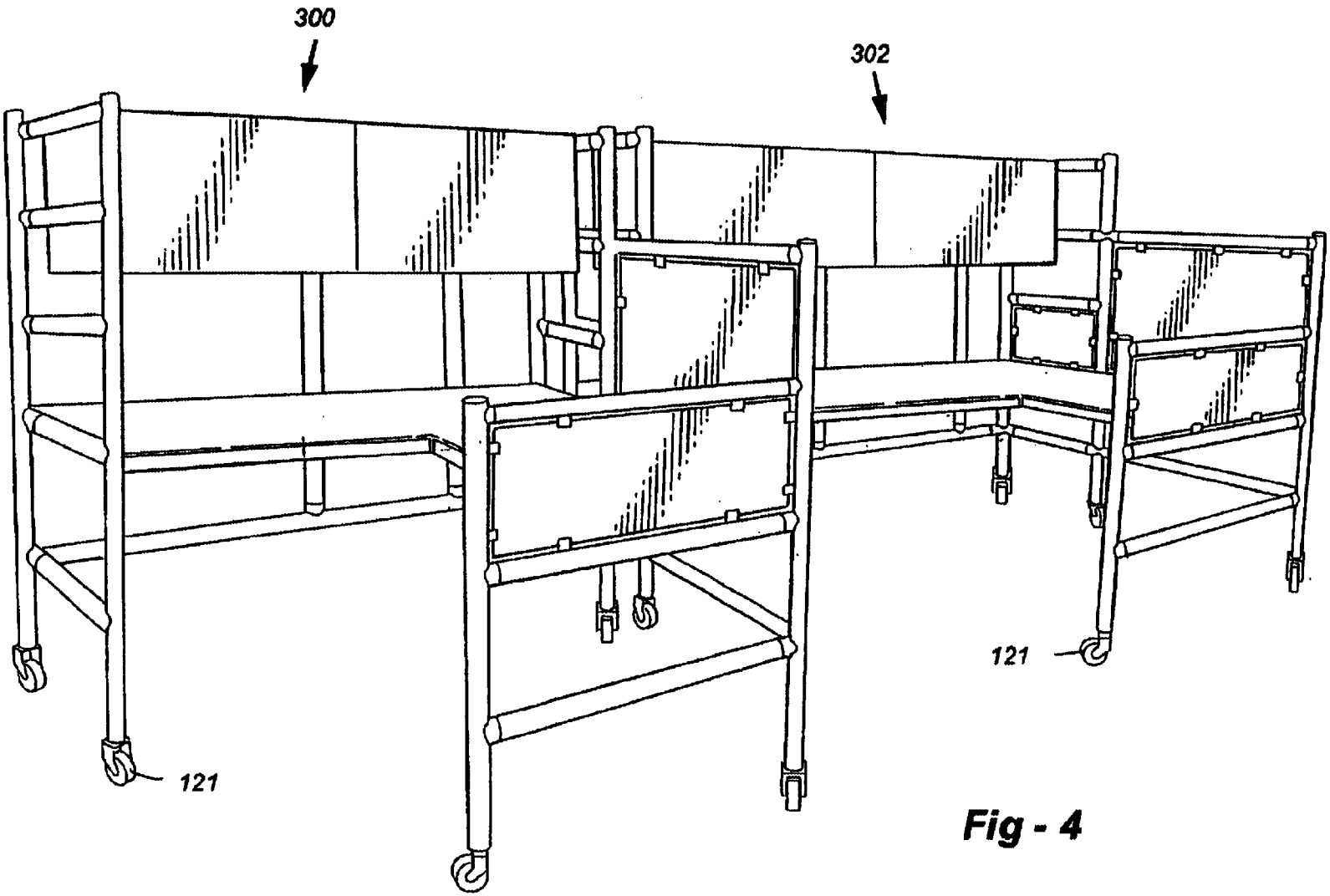
FIG. 4 is a perspective view of a pair of modular office cubicle systems according to the present invention arranged side-by-side.

FIG. 4 shows two cubicles 300 and 302 positioned side-by-side. These cubicles 300 and 302 may be interconnected using multi-axis or diagonal fittings, or two adjacent cubicles may share portions, such as a side portion. That is, the side portion in between two cubicles may form part of each of the cubicles, thereby interconnecting the cubicles. The casters may also be removed in a more permanent installation.

As will be clear to those of skill in the art, the illustrated embodiments of the present invention may be altered in various ways. However, such variations do not depart from the scope or teaching of the present invention.

I claim:

1. A modular office cubicle system, comprising:

a plurality of vertical members each having lower ends configured to rest on a floor;

a plurality of horizontal members extending between the vertical members such that the vertical and horizontal members cooperate to form a skeletal work cubicle adapted to at least partially surrounding a work area;

structural connection fittings removably interconnecting the horizontal members with the vertical members; and removable and replaceable polymerized sheathing surrounding at least one of the plurality of vertical members and some of the plurality of horizontal members;

a generally planar work top supported by some of the horizontal and vertical members in a generally horizontal position.

2. The modular office cubicle system according to claim 1, wherein the horizontal and vertical members define a plurality of generally vertical framed areas, the system further comprising a plurality of infill panels, each infill panel being supported in one of the framed areas and having an area which substantially consumes the framed area in which it is supported.

3. The modular office cubicle system according to claim 1, further comprising a cabinet suspended from some of the horizontal and vertical members.

4. The modular office cubicle system according to claim 1, wherein the lower ends of each of the vertical members has a caster.

5. The modular office cubicle system according to claim 1, wherein each of the horizontal and vertical members are hollow metal tubes.

6. The modular office cubicle system according to claim 5, wherein each polymerized sheathing has an interior diameter equal to or greater than the outer diameter of the metal tube it covers and extends the length of the tube it covers.

7. The modular office cubicle system according to claim 5, wherein at least one of the structural fittings comprises a slip-in fitting having a base with a radiused end surface matching the outer diameter of the polymerized sheathing covering one of the tubes, the fitting further having an engagement member extending from the base, the engagement member configured to engage the inner diameter of one of the tubes.

8. The modular office cubicle system according to claim 7, wherein the slip-in structural fitting further comprises a connector operable to connect the fitting to one of the tubes such that the end surface mates with the outer diameter of the sheathing covering the tube.

9. The modular office cubicle system according to claim 7, wherein the base of the slip-in structural fitting has an outer diameter substantially the same as the outer diameter of the polymerized sheathing covering the tube engaged by the engagement member.

10. The modular office cubicle system according to claim 7, wherein the engagement member comprises a pair of engagement fingers shaped to fit into the inner diameter of the tube engaged by the engagement member.

11. The modular office cubicle system according to claim 5, wherein at least one of the structural fittings comprises a slip-on fitting having an inner diameter greater than or equal to the outer diameter of the polymerized sheathing covering one of the tubes.

12. The modular office cubicle system according to claim 11, wherein the slip-on structural fitting further comprises a set screw operable to press against the polymerized sheathing or the tube such that the fitting grips the sheathing and the tube.

13. A modular office cubicle system, comprising:

a plurality of vertical members each having lower ends configured to rest on a floor;

a plurality of horizontal members extending between the vertical members such that the vertical and horizontal members cooperate to form a skeletal work cubicle at least partially surrounding a work area;

structural connection fittings removably interconnecting the horizontal members with the vertical members; and removable and replaceable polymerized sheathing surrounding at least one of the plurality of vertical members and some of the plurality of horizontal members; and the horizontal and vertical members defining a plurality of generally vertical framed areas, the system further comprising a plurality of infill panels, each infill panel being supported in one of the framed areas and having an area which substantially consumes the framed area in which it is supported.

14. The modular office cubicle system according to claim 13, wherein one or more of the infill panels comprise fabric covered panels.

15. The modular office cubicle system according to claim 13, wherein one or more of the infill panels comprise mesh panels.

16. The modular office cubicle system according to claim 13, wherein one or more of the infill panels comprise sound absorption panels.

17. The modular office cubicle system according to claim 13, further comprising a generally planar worktop supported by some of the horizontal and vertical members in a generally horizontal position.

18. The modular office cubicle system according to claim 13, wherein each of the horizontal and vertical members are hollow metal tubes.

19. The modular office cubicle system according to claim 18, wherein each polymerized sheathing has an interior diameter equal to or greater than the outer diameter of the metal tube it covers and extends the length of the tube it covers.

20. The modular office cubicle system according to claim 18, wherein at least one of the structural fittings comprises a slip-in fitting having a base with a radiused end surface matching the outer diameter of the polymerized sheathing covering one of the tubes, the fitting further having an engagement member extending from the base, the engagement member configured to engage the inner diameter of one of the tubes.

21. The modular office cubicle system according to claim 20, wherein the slip-in structural fitting further comprises a connector operable to connect the fitting to one of the tubes such that the end surface mates with the outer diameter of the sheathing covering the tube.

22. The modular office cubicle system according to claim 20, wherein the base of the slip-in structural fitting has an outer diameter substantially the same as the outer diameter of the polymerized sheathing covering the tube engaged by the engagement member.

23. The modular office cubicle system according to claim 20, wherein the engagement member comprises a pair of engagement fingers shaped to fit into the inner diameter of the tube engaged by the engagement member.

24. The modular office cubicle system according to claim 18, wherein at least one of the structural fittings comprises a slip-on fitting having an inner diameter greater than or equal to the outer diameter of the polymerized sheathing covering one of the tubes.

25. The modular office cubicle system according to claim 24, wherein the slip-on structural fitting further comprises a set screw operable to press against the polymerized sheathing or the tube such that the fitting grips the sheathing and the tube.

26. Modular office furniture, comprising:

a plurality of horizontal and vertical members having ends which are coupled with fittings to create a skeletal work area;

wherein some or all of the horizontal and vertical members are covered with polymeric sheathing; and a cabinet suspended from the horizontal and vertical members.

27. Modular office furniture, comprising:

a plurality of horizontal and vertical members having ends which are coupled with fittings to create a skeletal work area;

wherein some or all of the horizontal and vertical members are covered with polymeric sheathing;

the sheathing is co-extensive with the member being covered; and the fitting covers a portion of the sheathing.

28. Modular office furniture comprising:

a plurality of horizontal and vertical members having ends which are coupled with fittings to create a skeletal work area;

wherein some or all of the horizontal and vertical members are covered with polymeric sheathing;

the sheathing is shorter than the member being covered; and the fitting is relieved so that the sheathing is flush with an outer surface of the fitting.

29. A modular office cubicle system, comprising:

a plurality of vertical members each having lower ends configured to rest on a floor, said vertical members including a first, a second, and a third corner member;

a plurality of horizontal members extending between the corner member such that the vertical and horizontal members cooperate to form a back wall and a side wall that meet at an angle;

structural connection fittings removably interconnecting the horizontal embers with the corner members; and removable and replaceable polymerized sheathing surrounding at least some of the corner members and some of the plurality of horizontal members.

30. A modular office cubicle system, comprising:

a first side partition comprising;

a first pair of vertical members positioned generally parallel to each other and spaced apart by a first distance;

a first plurality of spaced apart generally parallel horizontal members extending between the first pair of vertical members;

structural connection fittings removably interconnecting the horizontal members in the first plurality with the first pair of vertical members;

a second side partition comprising;

a second pair of vertical members positioned generally parallel to each other and spaced apart by a second distance;

a second plurality of spaced apart generally parallel horizontal members extending between the second pair of vertical members;

structural connection fittings removably interconnecting the horizontal members in the second plurality with the second pair of vertical members;

a back wall comprising a pair of spaced apart generally horizontal members extending between one of the vertical members in the first pair and one of the vertical members in the second pair; and removable and replaceable polymerized sheathing surrounding at least some of the vertical members and some of the horizontal members.

31. The modular office cubicle system according to claim 30, further comprising:

a side wall extending from and aligned with the first side partition, the side wall comprising:

a vertical corner member spaced from the first side partition; and a pair of horizontal members extending between the first side partition and the vertical corner member; and a front wall extending from the corner member at an angle to the side wall, the front wall being generally parallel to the back wall, the front wall comprising:

a vertical end member spaced from the corner member; and a pair of horizontal members extending between the end member and the corner member.

* * * * *